US005461760A

United States Patent [19]

Damour

[11] Patent Number: 5,461,760

[45] Date of Patent: Oct. 31, 1995

[54] SLEEVE STRETCHER ASSEMBLY FOR A SPREADER ROLLER

[75] Inventor: Lawrence R. Damour, Succasunna, N.J.

[73] Assignee: Converter Accessory Corp., Wind Gap, Pa.

[21] Appl. No.: 305,203

[22] Filed: Sep. 13, 1994

[51] Int. Cl.[6] ..... D06C 3/06

[52] U.S. Cl. ..... 26/99; 26/100

[58] Field of Search ..... 26/99, 100, 97, 26/51, 71; 492/15, 16, 45, 47

[56] References Cited

U.S. PATENT DOCUMENTS

| | | | |
|---|---|---|---|
| 2,436,719 | 2/1948 | Hurxthal | 26/99 |
| 3,104,445 | 9/1963 | Wilford | 26/100 |
| 3,392,431 | 7/1968 | Bisang | 26/99 |
| 4,194,275 | 3/1980 | Freuler | 26/100 |
| 4,656,702 | 4/1987 | Tsuchida | 26/99 |
| 4,862,565 | 9/1989 | Damour | 26/99 |

FOREIGN PATENT DOCUMENTS

| | | | |
|---|---|---|---|
| 1088213 | 10/1967 | United Kingdom | 26/99 |

*Primary Examiner*—C. D. Crowder
*Assistant Examiner*—Amy B. Vanatta
*Attorney, Agent, or Firm*—Patrick J. Pinto

[57] ABSTRACT

A sleeve stretcher assembly for the ends of an elastomer sleeve of a spreader roller which includes a stationary shaft having at least one of its end portions configured as a tube. A slide rod is adapted for sliding interior of said tube in a direction parallel to an axis of the shaft. A hub member is arrayed exterior of said tube while being connected to the slide rod by a pivot means. An axis of the hub member is selectively tilted with respect to an axis of said shaft by a tilt adjusting means. The slide rod is selectively positioned interior of the tube by a linear adjusting means. The selected linear adjustment is maintained by a locking means.

10 Claims, 1 Drawing Sheet

SLEEVE STRETCHER ASSEMBLY FOR A SPREADER ROLLER

BACKGROUND OF THE INVENTION

1. Field of the Invention

With regard to the classification of art, this invention is believed to be found in the general class entitled "TEXTILES, CLOTH FINISHING" and more particularly to those subclasses pertaining to a STRETCHER ASSEMBLY for an elastomer sleeve portion of a spreader roller.

2. Description of Related Art

Expanding devices for webs of traveling material are well known. One example of such an expanding device is shown in U.S. Pat. No. 4,862,565, which was granted to the present inventor on Sep. 5, 1989. In that cited prior art patent, a spreader roller using a resilient sleeve member is rotated about a fixed shaft. The resilient sleeve member is expanded and contracted as it is rotated through 360 degrees of rotation. The expansion and contraction is adjustable and usually controlled by a pair of bearing blocks which are pivotally carried by the fixed shaft. The roller disclosed in U.S. Pat. No. 4,862,565 has been successfully used in the finishing of traveling webs of material.

However due to manufacturing tolerances for the elastomer sleeve, the spreader roller disclosed in U.S. Pat. No. 4,862,565 has required that the entire roller assembly be returned to the factory for replacement of a worn elastomer sleeve member. It certainly can be recognized that this would possibly place a hardship on the operators of the web handling equipment by reducing productivity.

It has been determined that there is a need to reduce the down time associated with the repair of a spreader roller. An apparatus which will allow the resilient sleeve member to be replaced at the work site will fill that need.

The present invention allows a technician, in the field, to replace the resilient sleeve member when necessary. This present invention only requires the use of ordinary tools for adjusting the position of the pivoting hub member. This stretcher assembly as disclosed in the present invention will allow a proper initial adjustment or stretching of the elastomer sleeve. This present invention also allows an independent tilting adjustment to be made. The present invention also allows dynamic adjustment of the tension on the sleeve of the spreader roller.

SUMMARY OF THE INVENTION

In brief, the present invention may be summarized as a sleeve stretcher assembly for a spreader roller comprising: a stationary shaft, at least one end of the stationary shaft having a tubular cross section, the stationary shaft further including a transverse aperture therethrough, the transverse aperture being selectively elongated; a slide rod being sized for slidable movement interior of the tubular cross section, the slidable movement being parallel to an axis of the stationary shaft; a hub member having an inside portion, and an outer peripheral portion, the hub member being pivotally mounted to the slide rod by a pivot means, the pivot means passing through the transverse aperture while being guided therein; the inside portion of the hub member being selectively sized for a predetermined loose fit on an outer portion of the tubular cross section of the stationary shaft, the hub member further including a tilt adjustment means for controlling the tilt of an axis of the hub member with respect to the axis of the stationary shaft, the outer portion of the hub member being adapted for journalling a rotatable sleeve portion of the spreader roller; a linear adjusting means for selective positioning the slide rod interior of the tubular cross section; and a locking means for maintaining the slide rod at a selected position interior of the tubular cross section.

In addition to the above summary, the following disclosure is intended to be detailed to insure adequacy and aid in the understanding of the invention. However, this disclosure, showing embodiments of the invention, is not intended to describe each new inventive concept which may arise. These specific embodiments have been chosen to show at least one best mode for the sleeve stretcher assembly for a spreader roller of the present invention. These specific embodiments, as shown in the accompanying drawings, may also include diagrammatic symbols for the purpose of illustration and understanding.

Figure 1:
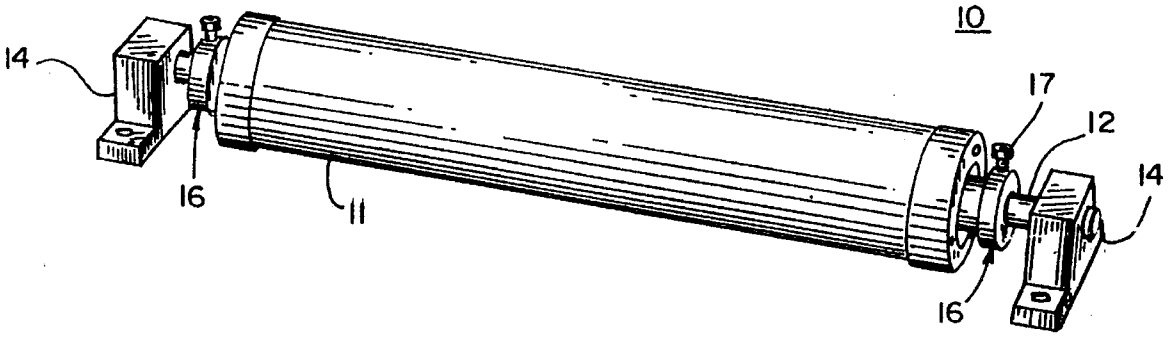
FIG. 1 represents a pictorial view of an assembled spreader roller.

In the following description and in the claims, various details are identified by specific names for convenience. These names are intended to be generic in their application while differentiating between the various details. Corresponding reference numbers refer to like members throughout the several figures of the drawing.

The drawing accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Referring first to FIG. 1, a typical spreader roller assembly is generally identified as 10. This typical spreader roller 10 is used to provide edge to edge stretching of fast moving webs of materials. The fast moving web of material is generally wrapped around the roller 10 for a predetermined arc length. This arc length of contact may be selectively adjusted between 10 degrees and 180 degrees. The fast moving web is generally removed from the roller 10 at or before the point of maximum sleeve length.

The roller assembly 10 includes an elastomer sleeve 11 and a stationary or fixed shaft 12. The fixed shaft may be fastened to a conveyor frame by a pair of mounting blocks 14. It is usually preferred that the mounting blocks 14 be of the clamping type, so that the position of the roller 10 may be adjusted to meet the needs of the material path.

Expansion and contraction of the elastomer sleeve 11 is controlled by at least one pivoting hub member 16. A tilt adjusting means 17 is used to control the angle or tilt of the axis of the hub member 16 with respect to the axis of the fixed shaft 12.

Figure 2:
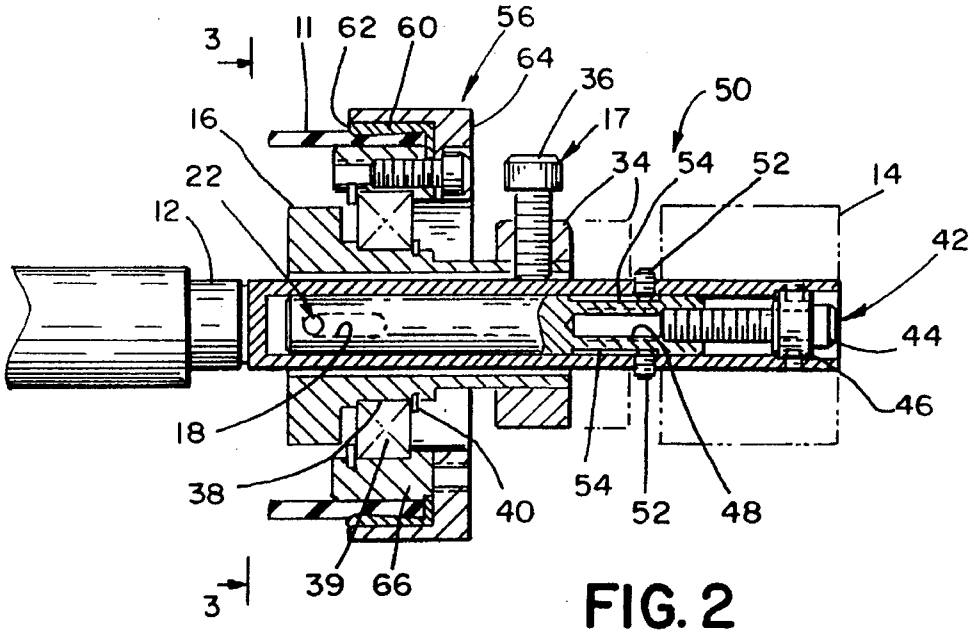
FIG. 2 represents an elevation, in section, of a one end of the spreader roller, this view in enlarged scale showing a sleeve stretcher assembly of the present invention.

Referring now to FIG. 2, at least one end of the stationary shaft 12 is bored to a predetermined depth for providing a substantially tubular cross section. An elongated transverse aperture 18 is formed at a selected position with respect to the end of the shaft 12. The elongated aperture 18 is formed through opposing walls of the tubular cross section.

An elongated slide rod 20, is sized to provide a close sliding fit with an interior portion of the tubular cross section of the stationary shaft 12. The slide rod 20 should easily slide along the axis of the stationary shaft 12.

Figure 3:
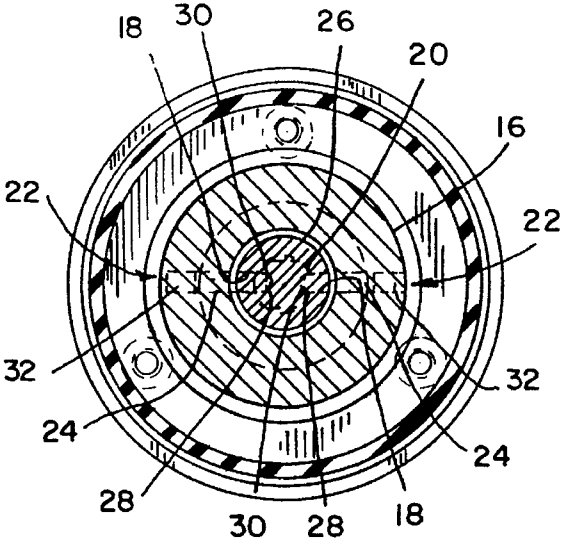
FIG. 3 represents a side elevation of the present invention, this view shown partly in section and being taken along line 3—3 of FIG. 2.

The hub member 16 is pivotally connected to the slide rod 20 by a pivot means 22. One example of a preferred pivot means may be seen in FIG. 3. A setscrew 24 is threaded into each of the opposing threaded apertures that are formed in the hub member 16. Each of these setscrews 24 are adjusted to a depth for centering the hub member 16 with respect to the outer portion 26 of the shaft 12. It is also preferred that each of the setscrews 24 have a pointed tip 28 for mating with the bottom of each of the blind holes 30. A second setscrew 32 is threaded into the hub member 16 for locking each of the setscrews 24 in place. Other types of adjustable pivot means may be used.

Referring again to FIG. 2, the pivot means 22 is linearly guided by the elongated transverse apertures 18. This linear guiding of the pivot means 22 also provides anti-rotation properties for the hub member 16 with respect to the shaft 12. As one example, it has been found that an elongated transverse aperture which allows 12.77 mm. (0.500 in) of pivot means 22 movement, provides the desired results for a 8.25 cm. (3.25 in.) diameter sleeve 11. The length of travel allowed by the elongated transverse aperture may need to be increased to suit a larger diameter sleeve or a sleeve which requires more stretch to run properly.

A tilt adjusting means 17 is also carried on the hub member 16. It is preferred that the tilt adjusting means 17 include a set screw collar 34 and an adjusting screw 36. The adjusting screw 36 should have a locking means, which is not shown, for maintaining its set position. One example of a locking means is an adjusting screw 36, that has an integral locking element in its threads.

An outer portion 38 of the hub member 16 is preferably arrayed for mounting of an anti friction bearing 39 thereon. This outer portion 38 of the hub member 16 may include a groove for a retaining ring 40. This anti friction bearing 39 allows the elastomer sleeve 11 to be rotated with respect to the shaft 12.

A linear adjusting means 42 is provided for positioning the slide rod 20 along the axis of the tubular cross section of the shaft 12. This linear adjusting means 42 includes an adjusting screw 44 which is journalled in block member 46. It is preferred that this journalled arrangement include a means for limiting the lateral movement of the screw 44 with respect to the block member 46. The threaded portion of the screw 44 is threaded into a threaded aperture 48 formed in one end of the slide rod 20.

A locking means 50 is used to maintain the position of the slide rod 20 with respect to the shaft 12 after adjustment is made. The preferred locking means 50 includes a pair of locking screws 52. It is preferred that flats 54 be provided on the slide rod 20. These flats 54 should be deep enough to allow tightening of the locking screws 52 without causing an interference fit between the slide rod 20 and the interior of the tubular cross section.

Each end of the elastomer sleeve member 11 is clamped to an end cap assembly 56 which is carried by an outer race of the anti friction bearing 39. It is preferred that the end cap assembly include a removable clamp assembly. This removable clamp assembly preferably includes a segmented clamping ring 60. An exterior surface of the clamping ring 60 is tapered. An opening at a mouth 62 of the segmented clamping ring 60 is reduced when an end cap member 64 is seated against a bearing mount 66. In this seated condition the action of the end cap member 64 cooperating with the taper causes the mouth 62 to close.

A spreader roller may be fitted with at least one sleeve stretcher assembly. In the case of a short spreader roller, it may be sufficient to provide the sleeve spreader assembly at one end only. For long spreader rollers, it is recommended that the sleeve spreader assembly be provided at each end of the sleeve.

The stretcher assembly of the present invention allows field adjustment of the tension of the sleeve 11. This tension is adjustable to compensate for angular rotation of the roller, temperature rise of the sleeve, as well as manufacturing tolerances. The present invention allows for dynamic adjustment of the spreader roller.

Directional terms such as "front", "back", "in", "out", downward, and the like are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A sleeve stretcher assembly for a spreader roller comprising:

(a) a stationary shaft, at least one end of said stationary shaft having a tubular cross section, said stationary shaft further including a transverse aperture therethrough, said transverse aperture being selectively elongated;

(b) a slide rod being sized for slidable movement interior of said tubular cross section, said slidable movement being parallel to an axis of said stationary shaft;

(c) a hub member having an inside portion, and an outer peripheral portion, said hub member being pivotally connected to said slide rod by a pivot means, said pivot means passing through said transverse aperture while being guided therein; said inside portion of said hub member being selectively sized for a predetermined loose fit on an outer portion of said tubular cross section of said stationary shaft, said hub member further including a tilt adjustment means for controlling the tilt of an axis of said hub member with respect to said axis of said stationary shaft, said outer portion of said hub member being adapted for journalling a rotatable sleeve portion of the spreader roller;

(d) a linear adjusting means for selective positioning said slide rod interior of said tubular cross section; and (e) a locking means for maintaining said slide rod at a selected position interior of said tubular cross section.

2. A sleeve stretcher assembly as recited in claim 1 wherein said tubular cross section includes an inside diameter and said slide rod is round.

3. A sleeve stretcher assembly as recited in claim 1 wherein said pivot means is adjustable for placing said hub member in a preferred alignment with said stationary shaft.

4. A sleeve stretcher assembly as recited in claim 3 wherein a locking screw maintains said preferred alignment of said hub member with said stationary shaft.

5. A sleeve stretcher assembly as recited in claim 1 wherein said tilt adjustment means includes a threaded collar and an adjusting screw.

6. A sleeve stretcher assembly as recited in claim 1 wherein said linear adjusting means includes a linear adjusting screw being journalled in a block member, a threaded portion of said linear adjusting being threaded into a threaded aperture of said slide rod.

7. A sleeve stretcher assembly as recited in claim 1 wherein said locking means for maintaining said slide rod includes at least one locking screw being threaded into said stationary shaft.

8. A sleeve stretcher assembly as recited in claim 7 wherein said slide rod includes at least one flat, each of said flats for allowing said locking screw to be tightened absent damage to a sliding surface of said slide rod.

9. A sleeve stretcher assembly as recited in claim 1 wherein an end of a sleeve member of said rotatable sleeve portion is clamped to an end cap assembly by a removable clamp assembly.

10. A sleeve stretcher assembly as recited in claim 9 wherein said removable clamp assembly includes a segmented clamping ring.

* * * * *